US011105165B2

(12) United States Patent
He et al.

(10) Patent No.: US 11,105,165 B2
(45) Date of Patent: Aug. 31, 2021

(54) DOWNHOLE DEVICE INCLUDING A FLUID PROPULSION SYSTEM

(71) Applicants: Zhi Yong He, Cypress, TX (US); Yuh Loh, Cypress, TX (US); Jason M. Harper, Cypress, TX (US); Ronnie Russell, Cypress, TX (US); Do Seo Park, Houston, TX (US)

(72) Inventors: Zhi Yong He, Cypress, TX (US); Yuh Loh, Cypress, TX (US); Jason M. Harper, Cypress, TX (US); Ronnie Russell, Cypress, TX (US); Do Seo Park, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/671,974

(22) Filed: Nov. 1, 2019

(65) Prior Publication Data

US 2021/0131209 A1 May 6, 2021

(51) Int. Cl.

| | |
|---|---|
| ***E21B 23/00*** | (2006.01) |
| ***E21B 37/00*** | (2006.01) |
| ***E21B 43/16*** | (2006.01) |

(52) U.S. Cl.

CPC ..... *E21B 23/00* (2013.01); *E21B 37/00* (2013.01); *E21B 43/16* (2013.01); *E21B 23/001* (2020.05)

(58) Field of Classification Search

CPC ..... E21B 23/00; E21B 43/16; E21B 37/00; E21B 23/001

See application file for complete search history.

(56) References Cited

U.S. PATENT DOCUMENTS

| | | | | |
|---|---|---|---|---|
| 6,360,823 | B1 * | 3/2002 | Ranson | E21B 23/00 166/381 |
| 6,378,627 | B1 * | 4/2002 | Tubel | E21B 17/1078 175/24 |
| 2013/0319661 | A1 * | 12/2013 | Xiao | E21B 43/121 166/250.03 |
| 2014/0311755 | A1 * | 10/2014 | Al-Badran | E21B 23/14 166/381 |
| 2016/0251941 | A1 * | 9/2016 | Murphree | E21B 41/00 166/387 |
| 2019/0368331 | A1 * | 12/2019 | Vick, Jr. | F03B 13/02 |

FOREIGN PATENT DOCUMENTS

| | | | | |
|---|---|---|---|---|
| WO | WO-2005084833 | A1 * | 9/2005 | B08B 9/049 |

* cited by examiner

*Primary Examiner* — James G Sayre
(74) *Attorney, Agent, or Firm* — Cantor Colburn LLP

(57) ABSTRACT

An embodiment of a downhole device includes an elongated body configured to be deployed in a borehole in an earth formation, the borehole including a borehole fluid. The device also includes a propulsion system attached to the body and configured to move the device through the borehole. The propulsion system includes one or more rotor blades configured to generate thrust using the borehole fluid. At least part of the one or more rotor blades is disposed external to the elongated body.

20 Claims, 4 Drawing Sheets

DOWNHOLE DEVICE INCLUDING A FLUID PROPULSION SYSTEM

BACKGROUND

In the resource exploration and recovery industry, boreholes are formed in a formation for the purpose of evaluating formation properties and to extract formation fluids. Prior to extracting formation fluids, a completion is typically formed in the borehole, and may separate the borehole into various production zones through the use of packers.

It may be desirable to inject a treatment fluid into the borehole and/or formation to perform functions such as removing blockages, cleaning the borehole and treating formation fluids flowing toward the surface. In some cases, the completion does not include installed treatment fluid injection systems. In such cases, a fluid injection system is deployed into the completion using a running string such as wireline or coiled tubing.

SUMMARY

An embodiment of a downhole device includes an elongated body configured to be deployed in a borehole in an earth formation, the borehole including a borehole fluid. The device also includes a propulsion system attached to the body and configured to move the device through the borehole. The propulsion system includes one or more rotor blades configured to generate thrust using the borehole fluid. At least part of the one or more rotor blades is disposed external to the elongated body.

An embodiment of a method of deploying a device in a borehole in an earth formation includes disposing the device in the borehole including a borehole fluid, the device including an elongated body and a propulsion system including one or more rotor blades. The method also includes moving the device through the borehole to a selected location. Moving the device includes rotating the one or more rotor blades to generate thrust using the borehole fluid, and at least part of the one or more rotor blades is disposed external to the elongated body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

A downhole device including a propulsion device or system, and methods of performing downhole operations, are described herein. An embodiment of the device includes an elongated body and a propulsion system that includes one or more rotor blades that are operable to generate thrust using borehole fluid and thereby move the device through the borehole. The propulsion system, in one embodiment, includes one or more turbines, which may be operated via hydraulic or electric control.

An example of a downhole device is a fluid injection device configured to inject treatment fluid into a borehole and/or a formation region from a location in the borehole.

Embodiments described herein provide a number of advantages and technical effects. For example, embodiments allow for devices, tools or components to be deployed and advanced along a borehole (including horizontal and deviated boreholes) without the need for wireline, coiled tubing or other carriers. In addition, modular features described herein allow for ease of modifying the downhole device to provide for desired propulsion characteristics (e.g., by changing the size and/or number of turbines) and/or to connect propulsion features to various other tools or components. In embodiments where the described device is a fluid injection device, the device allows for cost effective fluid injection at desired locations in completions that do not have pre-existing fluid injection lines.

Figure 1:
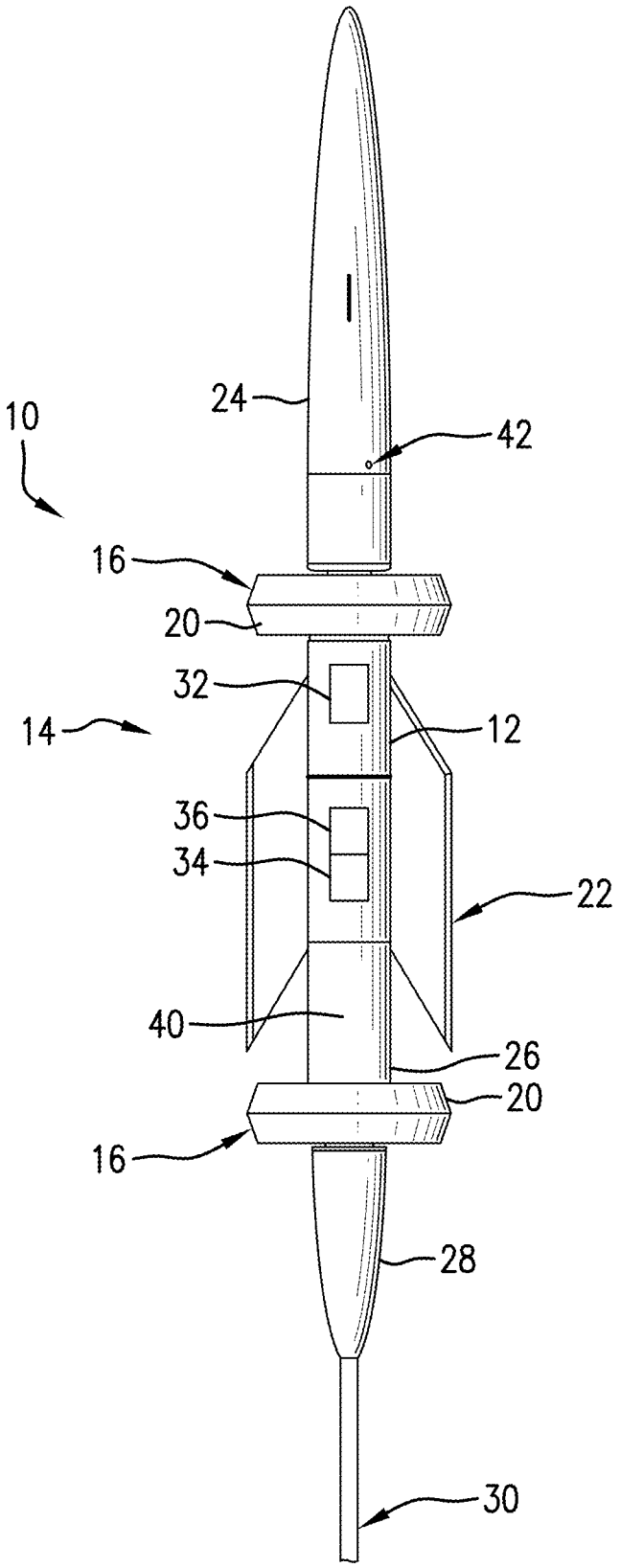
FIG. 1 is a side view of an embodiment of a downhole device including a propulsion system configured to move the downhole device using borehole fluid.
Figure 2:
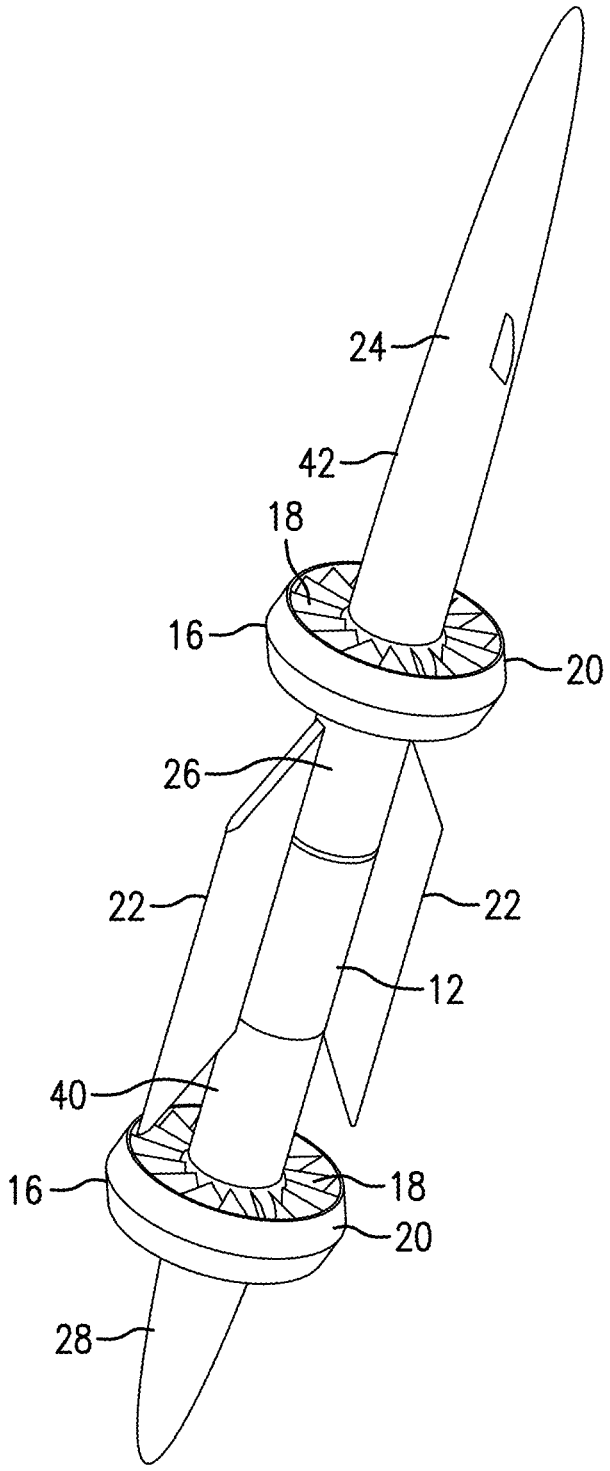
FIG. 2 is a perspective view of the device of FIG. 1.

FIGS. 1 and 2 depict an embodiment of a downhole device 10. The downhole device 10 is configured to be deployed downhole to perform one or more of various functions related to, for example, completion of a borehole and/or hydrocarbon production. The downhole device 10 includes an elongated body 12 attached to a propulsion system 14, which includes one or more propulsion devices configured to use borehole fluid within a borehole to generate a propulsive force and move the downhole device 10 through a length of a borehole. Thus, the device 10 can be advanced and/or retracted through the borehole without requiring wired pipe, coiled tubing or other strings connected to the surface.

The propulsion system 14 includes any type and/or number of propulsion devices that can be operated to generate a propulsive force using borehole fluid. Borehole fluid may include any combination of fluids in a borehole, such as drilling mud circulated through a borehole and/or formation fluids that enter the borehole. Propulsion devices may include devices having rotary blades, such as propellers, fans, turbines and/or any suitable devices that can generate thrust using borehole fluid to move the device 10.

A rotary blade, as described herein, is intended to refer to any rotating wing, blade, fan or other component that generates thrust via rotational movement. In the following description, the downhole device 10 is described as including turbines, however it is to be understood that other propulsion devices can be used in place of turbines or in addition to turbines.

In one embodiment, the propulsion system 14 includes one or more turbines 16, each of which has a plurality of fan blades 18 disposed in a turbine housing 20. The blades 18 may have a fixed pitch, or the device 10 may include an actuator or control device configured to vary the pitch. In one embodiment, at least part of each blade 18 is external to the elongated body 12 and extends radially outwardly from an external surface of the body 12. As shown in FIGS. 1 and 2, the blades may be arrayed circumferentially around the body 12 and rotate about a longitudinal axis of the body 12.

The turbines 16 may have any size suitable for deployment into a borehole and/or for guiding the downhole device 10. For example, the diameter of the turbine housing 20 is substantially equal to a diameter of a borehole (cased or open hole), or has a diameter within a selected tolerance from the diameter of the borehole, to facilitate guiding the device 10. The turbine housing 20 may include other features to facilitate deployment, such as a ring bearing or other bearing mechanism at an exterior surface of the housing 20, a selected surface roughness, or a protective layer of material between the housing 20 and the borehole.

In the embodiment of FIGS. 1 and 2, the device 10 includes two turbines 16 at different axial locations (locations along the longitudinal axis of the body 12). The turbines 16 may be configured to rotate in the same direction. In one embodiment, the turbines 16 are rotated in opposite directions (contra-rotating) to provide additional compressive power and to reduce torque on the body 12. The propulsion system 14 may include any number of turbines 16, depending on, for example, the size of the borehole and the amount of thrust desired.

The device 10 may include one or more fins 22 that can be used, for example, to provide stability and/or directional control. For example, an electric or hydraulic actuator can be included in the body to manipulate the fins 22 and facilitate steering (e.g., to enter a lateral borehole). Other directional control devices may be included, in addition to or in place of the fins 22.

In one embodiment, the body 12 includes various body segments, which may be part of a unitary body or attached in fixed relationship to one another (e.g., as separate modules). For example, the body 12 includes a head segment 24, a central segment 26 and a tail segment 28. The segments may be fixedly disposed to each other, or one or more segments may be moveable and/or releasably connected to other segments. For example, the head segment 24 may be configured to be moveable to tilt the head segment in radial directions to facilitate steering.

The turbines 16, head segment 24, fins 22 and/or other components of the device 10 may be controlled and/or powered via any suitable mechanism. For example, control lines such as electrical conductors and/or hydraulic control lines may be connected to the surface via a cable 30.

For example, the turbines 16 are controlled and powered electrically via conductors in the cable 30 connected to one or more electric motors 32 for rotating the turbine blades 18. The electric motor 30 may be part of a control system for controlling various device components including the turbines 16. Other components of the control system may include actuators for controlling steering mechanisms, such as the fins 22 and/or the head segment 24. The control system may be a modular component that can be releasably connected to other device components.

Although only one electric motor 32 is shown, the device 10 is not so limited. For example, each turbine 16 may be part of a module having a motor and a drive shaft, to allow for ease of replacement of turbines 16 (e.g., to replace a damaged turbine 16 or replace an existing turbine 16 with a turbine having different characteristics), and to allow for the number and/or position of turbines 16 to be changes.

The device 10 and/or components thereof may be electrically powered. Electrical power may be provided via one or more conductors in the cable 30. Alternatively, or in combination with electrical power provided from the surface, electrical power can be supplied by a battery 34 or other downhole power source, which can be used for primary or backup power.

The device 10 may be controlled from the surface by an operator and/or processing unit at a drill rig or other surface location. The device may also be controlled from a downhole location. For example, the device may include a controller 36 or other processing device, which can be powered by the battery 34.

In one embodiment, the device 10 is configured as a fluid injection device, which can be used to inject treatment fluids or chemicals for various purposes. Such purposes include improved oil recovery, well cleanup, removing blockages in perforations, etc.

For example, the device 10 includes a fluid injection assembly 40 that includes components for controlling injection of fluid, such as valves and fluid sensors. The fluid injection assembly 40 also includes one or more fluid outlet ports 42. The fluid injection assembly 40 is connected to a source of treatment fluid for injection by a fluid line, which may be part of the cable 30 or a separate fluid line.

Figure 3:
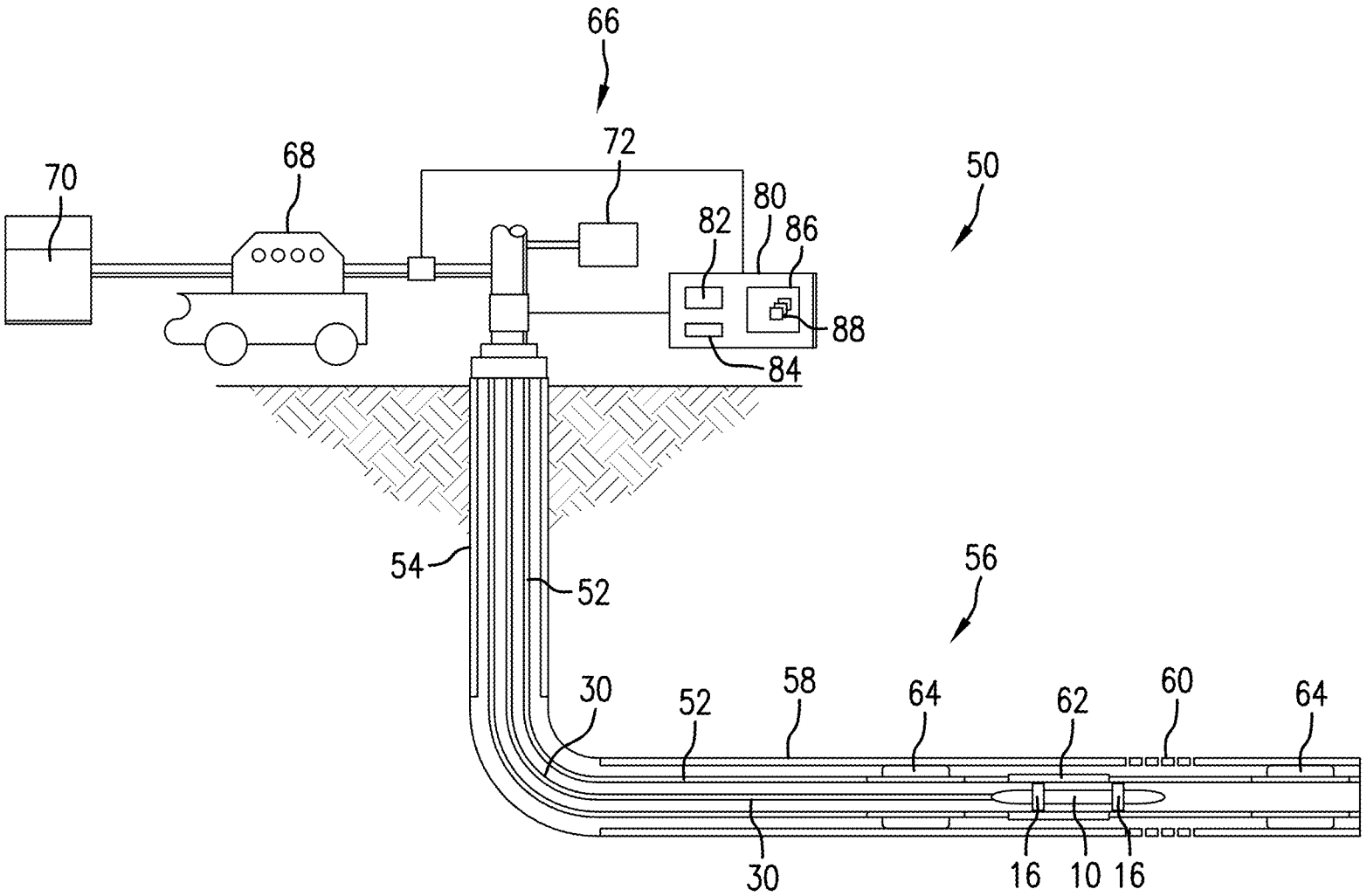
FIG. 3 depicts a system for performing downhole operations.

FIG. 3 illustrates an embodiment of a system 50 for performing downhole operations, such as a completion and hydrocarbon production system 50. The system 50 includes a borehole string 52, such as a production string, that is configured to be disposed in a borehole 54 that penetrates a resource bearing formation 56 or formation region. The borehole 54 may include casing 58 having one or more perforations 60 and/or ports at one or more production zones. The borehole string 52 includes various components to facilitate stimulation and/or production, such as a production assembly 62 that includes a screen assembly (e.g., a sand screen assembly or sub) and/or a production fluid flow control apparatus such as an inflow control device (ICD). Production zones may be bounded by packer assemblies 64.

The system 50 also includes surface equipment 66 such as a drill rig, rotary table, top drive, blowout preventer and/or others to facilitate deploying the borehole string 12 and/or controlling downhole component. For example, the surface equipment 66 includes a borehole fluid control system 68 including one or more pumps in fluid communication with a fluid tank 70 or other fluid source. The fluid control system 68 controls circulation of borehole fluid (e.g., drilling mud)

The surface equipment also includes an injection control system configured to control injection of fluid from an injection fluid source 72 into a fluid line in the cable 30.

In one embodiment, the system 10 includes a processing device such as a surface processing unit 80, and/or a subsurface processing unit. The surface processing unit 80, in one embodiment, includes a processor 82, an input/output device 84 and a data storage device (or a computer-readable medium) 86 for storing data, files, models, data analysis modules and/or computer programs. The processing device may be configured to perform functions such as controlling downhole components, controlling fluid circulation, monitoring components during deployment, transmitting and receiving data, processing measurement data and/or monitoring operations. For example, the storage device 84 stores processing modules 88 for performing one or more of the above functions.

In one embodiment, the surface processing unit 80 includes functionality for controlling operation of the device 10 and the propulsion system 14. For example, the surface processing unit 80 can communicate with the device via, for example, electrical conductors and/or optical fibers and control operation of the propulsion system 14. The surface processing unit 80 can also control downhole components such as the fluid injection assembly 40.

Figure 4:
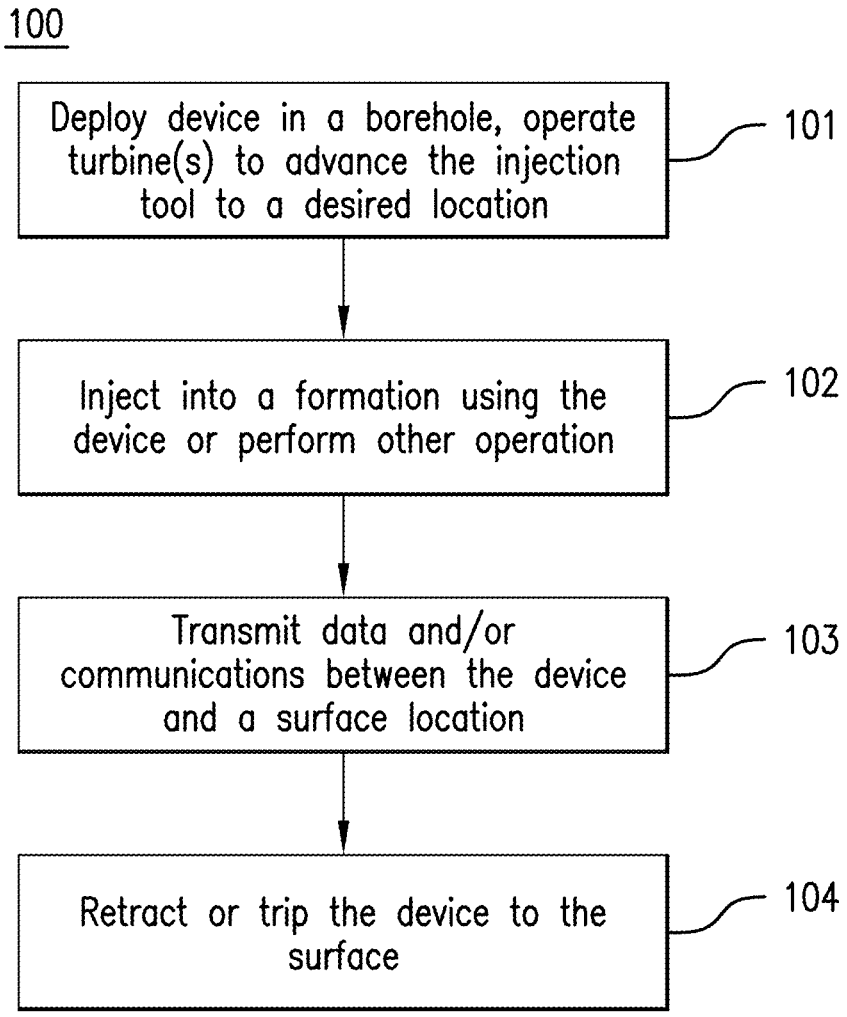
FIG. 4 is a flow chart depicting an embodiment of a method of deploying a downhole device into a borehole and/or performing a downhole operation.

FIG. 4 is a flow chart that illustrates an embodiment of a method 100 of monitoring downhole components during deployment, and/or controlling aspects of an energy industry operation. Aspects of the method 100, or functions or operations performed in conjunction with the method, may be performed by one or more processing devices, such as the surface processing unit 80 and/or the controller 36, either alone or in conjunction with a human operator.

The method 100 includes one or more stages 101-104. In one embodiment, the method 100 includes the execution of all of the stages 101-104 in the order described. However, certain stages may be omitted, stages may be added, or the order of the stages changed.

The method 100 is discussed in conjunction with the system of FIG. 3 and the device 10 of FIGS. 1 and 2 for illustrative purposes. It is noted that the method is not limited to the specific embodiment discussed below.

In the first stage 101, the device 10 is deployed into a borehole such as the borehole 54. The propulsion system 14 is activated at a desired point in the borehole 54 and the turbines 16 are operated to rotate the blades 18. Rotation of the blades 18 accelerates borehole fluid (e.g., drilling mud and/or formation fluid in the borehole 54), creating a pressure difference that propels the device 10.

The propulsion system 14 can be activated and operated during the entire trip into the borehole, or operated in certain lengths or sections of the borehole 54. For example, the device 10 is pumped or advanced through a vertical or deviated section of the borehole 54, and activated upon approaching or entering a lateral (e.g., horizontal section of the borehole 54). Steering mechanisms such as those discussed above may be used to steer the device 10, e.g., to direct the device 10 to the lateral.

In the second stage 102, one or more downhole operations are performed using the device 10 or in conjunction with the device 10. Examples of such operations include drilling operations, flow control operations, cleaning operations and others. In one embodiment, the device 10 is configured to inject treatment fluid into the borehole 54 and includes components such as the fluid injection assembly 40. Treatment fluid refers to any fluid or combination of fluids that are injected into the borehole 54 to accomplish various functions. Examples of treatment fluid include water, gas, hydrocarbons, and chemical treatment fluids.

Treatment fluid may be injected to enhance production by improving various characteristics of the formation fluids being produced and/or improving completion performance (e.g., by removing scale, plugs and/or accumulated sediment). For example, the device 10, upon being disposed at a selected production zone, injects a chemical inhibitor and/or solvent to prevent and/or remove scale deposits.

In one embodiment, the device 10 can be used to clear sediment or other unwanted material. For example, the fluid output port 42 includes a nozzle that ejects high pressure fluid to aerate or disturb sediments. In another example, rotation of the turbines 16 can be used to disturb sediments and facilitate washing the sediments out.

In the third stage 103, data and/or communications are transmitted from the surface via, for example, a conductor or optical fiber in the cable 30. Other forms of communication may be used, such as mud pulse telemetry and wireless (e.g., acoustic or electromagnetic) communication. Communications may be transmitted from the surface to control operation of the device 10, the propulsion system 14 and/or the fluid injection assembly 40.

In the fourth stage 104, the device 10 is retracted or tripped to the surface. Tripping can be accomplished, for example, by pulling the device 10 out and/or by reversing the turbines 16 to reverse thrust and push the device 10 toward the surface.

Set forth below are some embodiments of the foregoing disclosure:

Embodiment 1: A downhole device comprising: an elongated body configured to be deployed in a borehole in an earth formation, the borehole including a borehole fluid; and a propulsion system attached to the body and configured to move the device through the borehole, the propulsion system including one or more rotor blades configured to generate thrust using the borehole fluid, at least part of the one or more rotor blades disposed external to the elongated body.

Embodiment 2: The device of any prior embodiment, wherein the propulsion system includes at least one of a propeller including a plurality of rotor blades, and a turbine including a plurality of rotor blades configured to rotate within a turbine housing.

Embodiment 3: The device of any prior embodiment, further comprising at least one fin attached to the elongated body.

Embodiment 4: The device of any prior embodiment, wherein the at least one fin is adjustable to control a direction of movement of the device.

Embodiment 5: The device of any prior embodiment, wherein the propulsion system is a modular assembly configured to be removably connected to the body.

Embodiment 6: The device of any prior embodiment, further comprising a fluid injection system disposed at the body, the fluid injection system configured to inject a treatment fluid into at least one of the borehole and a formation region around the borehole.

Embodiment 7: The device of any prior embodiment, wherein the propulsion system is configured to be operated using at least one of electrical signals and hydraulic signals.

Embodiment 8: The device of any prior embodiment, wherein the device is configured to be connected to a surface location by a control line including at least one of an electrical conductor and a hydraulic control line.

Embodiment 9: The device of any prior embodiment, further comprising an electrical power source connected to the propulsion system.

Embodiment 10: The device of any prior embodiment, wherein the body includes a cylindrical housing having a longitudinal axis, the propulsion system includes a turbine having a plurality of fan blades configured to rotate about the longitudinal axis.

Embodiment 11: A method of deploying a device in a borehole in an earth formation, the method comprising: disposing the device in the borehole, the borehole including a borehole fluid, the device including an elongated body and a propulsion system including one or more rotor blades; and moving the device through the borehole to a selected location, wherein the moving includes rotating the one or more rotor blades to generate thrust using the borehole fluid, at least part of the one or more rotor blades disposed external to the elongated body.

Embodiment 12: The device of any prior embodiment, wherein the propulsion system includes at least one of a propeller including a plurality of rotor blades, and a turbine including a plurality of rotor blades configured to rotate within a turbine housing.

Embodiment 13: The device of any prior embodiment, further comprising at least one fin attached to the elongated body.

Embodiment 14: The device of any prior embodiment, wherein moving the device includes adjusting the at least one fin to control a direction of movement of the device.

Embodiment 15: The device of any prior embodiment, wherein the propulsion system is a modular assembly configured to be removably connected to the body.

Embodiment 16: The device of any prior embodiment, further comprising injecting a treatment fluid into at least one of the borehole and a formation region around the borehole via a fluid injection system disposed at the body.

Embodiment 17: The device of any prior embodiment, wherein the propulsion system is configured to be operated using at least one of electrical signals and hydraulic signals.

Embodiment 18: The device of any prior embodiment, wherein the device is connected to a surface location by a control line including at least one of an electrical conductor and a hydraulic control line.

Embodiment 19: The device of any prior embodiment, wherein the device includes an electrical power source connected to the propulsion system.

Embodiment 20: The device of any prior embodiment, wherein the body includes a cylindrical housing having a longitudinal axis, the propulsion system includes a turbine having a plurality of fan blades configured to rotate about the longitudinal axis.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A downhole device comprising:

an elongated body configured to be deployed in a borehole in an earth formation, the borehole including a borehole fluid; and a propulsion system attached to the body and configured to move the device through the borehole, the propulsion system including one or more rotor blades configured to generate thrust using the borehole fluid, at least part of the one or more rotor blades disposed external to the elongated body; and a steering device including at least one fin extending from the elongated body, wherein the at least one fin is adjustable to control a direction of movement of the device, the direction of movement including at least a lateral direction relative to the borehole.

2. The device of claim 1, wherein the propulsion system includes at least one of a propeller including a plurality of rotor blades, and a turbine including a plurality of rotor blades configured to rotate within a turbine housing.

3. The device of claim 1, wherein the elongated body includes a first modular body segment including the propulsion system, and a second modular body segment including the at least one fin, the first body segment configured to be removably connected to the second body segment.

4. The device of claim 1, wherein the propulsion system includes a first propulsion system disposed at a first location along the elongated body and a second propulsion system disposed at a second location along the elongated body, and wherein the at least one fin is attached to the elongated body between the first location and the second location.

5. The device of claim 1, wherein the propulsion system is a modular assembly configured to be removably connected to the body.

6. The device of claim 1, further comprising a fluid injection system disposed at the body, the fluid injection system configured to inject a treatment fluid into at least one of the borehole and a formation region around the borehole.

7. The device of claim 1, wherein the propulsion system is configured to be operated using at least one of electrical signals and hydraulic signals.

8. The device of claim 7, wherein the device is configured to be connected to a surface location by a control line including at least one of an electrical conductor and a hydraulic control line.

9. The device of claim 7, further comprising an electrical power source connected to the propulsion system.

10. The device of claim 1, wherein the body includes a cylindrical housing having a longitudinal axis, the propulsion system includes a turbine having a plurality of fan blades configured to rotate about the longitudinal axis.

11. A method of deploying a device in a borehole in an earth formation, the method comprising:

disposing the device in the borehole, the borehole including a borehole fluid, the device including an elongated body and a propulsion system including one or more rotor blades; and moving the device through the borehole to a selected location, wherein the moving includes rotating the one or more rotor blades to generate thrust using the borehole fluid, at least part of the one or more rotor blades disposed external to the elongated body; and controlling a direction of movement of the device by a steering device including at least one fin extending from the elongated body, the direction of movement including at least a lateral direction relative to the borehole.

12. The method of claim 11, wherein the propulsion system includes at least one of a propeller including a plurality of rotor blades, and a turbine including a plurality of rotor blades configured to rotate within a turbine housing.

13. The method of claim 11, wherein the elongated body includes a first modular body segment including the propulsion system, and a second modular body segment including the at least one fin, the first body segment configured to be removably connected to the second body segment.

14. The method of claim 13, wherein controlling the direction of movement includes adjusting the at least one fin to control a direction of movement of the device.

15. The method of claim 11, wherein the propulsion system includes a first propulsion system disposed at a first location along the elongated body and a second propulsion system disposed at a second location along the elongated body, and wherein the at least one fin is attached to the elongated body between the first location and the second location.

16. The method of claim 11, further comprising injecting a treatment fluid into at least one of the borehole and a formation region around the borehole via a fluid injection system disposed at the body.

17. The method of claim 11, wherein the propulsion system is configured to be operated using at least one of electrical signals and hydraulic signals.

18. The method of claim 17, wherein the device is connected to a surface location by a control line including at least one of an electrical conductor and a hydraulic control line.

19. The method of claim 17, wherein the device includes an electrical power source connected to the propulsion system.

20. The method of claim 11, wherein the body includes a cylindrical housing having a longitudinal axis, the propulsion system includes a turbine having a plurality of fan blades configured to rotate about the longitudinal axis.

* * * * *